US010325764B2

(12) United States Patent
Gordon et al.

(10) Patent No.: US 10,325,764 B2
(45) **Date of Patent: *Jun. 18, 2019**

(54) AUTOMATED BEAM CHECK

(71) Applicant: Micromass UK Limited, Wilmslow, Cheshire (GB)

(72) Inventors: David Gordon, Manchester (GB); Daniel James Kenny, Knutsford (GB); Howard Read, Altrincham (GB); Kate Whyatt, Cheshire (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/837,016

(22) Filed: Dec. 11, 2017

(65) Prior Publication Data

US 2018/0102241 A1 Apr. 12, 2018

Related U.S. Application Data

(63) Continuation of application No. 15/022,444, filed as application No. PCT/GB2014/052811 on Sep. 17, 2013, now Pat. No. 9,842,727.

(30) Foreign Application Priority Data

Sep. 20, 2013 (EP) ..... 13185399
Sep. 20, 2013 (GB) ..... 1316741.6

(51) Int. Cl.
*H01J 49/00* (2006.01)
*H01J 49/10* (2006.01)

(52) U.S. Cl.
CPC ..... *H01J 49/0009* (2013.01); *H01J 49/0031* (2013.01); *H01J 49/10* (2013.01)

(58) Field of Classification Search
CPC ..... H01J 49/00; H01J 49/10; H01J 49/26
(Continued)

(56) References Cited

U.S. PATENT DOCUMENTS 3,831,026 A 8/1974 Powers
4,849,628 A 7/1989 McLuckey et al.
(Continued)

FOREIGN PATENT DOCUMENTS

WO 2013/081581 A1 6/2013

OTHER PUBLICATIONS

International Search Report and Written Opinion dated Dec. 8, 2017 and dated Dec. 15, 2017 for International Application No. PCT/GB2014/052811.

*Primary Examiner* — Nicole M Ippolito
(74) *Attorney, Agent, or Firm* — Womble Bond Dickinson (US) LLP; Deborah M. Vernon; Heath T. Misley

(57) ABSTRACT

A method of automatically performing a routine to check the operational state of a mass spectrometer is disclosed wherein the method is performed automatically as a start-up routine upon switching ON the mass spectrometer. The method comprises automatically generating a vacuum within one or more vacuum chambers of a mass spectrometer and automatically generating first ions using an internal ion source, wherein the internal ion source is located within a vacuum chamber of the mass spectrometer or is located within a chamber downstream from an atmospheric pressure interface, and detecting at least some of the first ions or second ions derived from the first ions. The method further comprises automatically determining whether or not the mass spectrometer is in a correct operational state.

11 Claims, 5 Drawing Sheets

(58) Field of Classification Search
USPC ..... 250/281, 282, 288
See application file for complete search history.

(56) References Cited

U.S. PATENT DOCUMENTS

| | | | | |
|---|---|---|---|---|
| 5,304,798 | A | 4/1994 | Tomany et al. | |
| 5,463,219 | A | 10/1995 | Buckley et al. | |
| 5,498,545 | A | 3/1996 | Vestal | |
| 5,703,360 | A | 12/1997 | Fischer | |
| 6,649,909 | B2 | 11/2003 | Russ, IV et al. | |
| 6,797,947 | B2 | 9/2004 | Russ, IV et al. | |
| 6,822,223 | B2 | 11/2004 | Davis | |
| 7,372,042 | B2 | 5/2008 | Mordehai et al. | |
| 7,385,190 | B2 | 6/2008 | Fischer et al. | |
| 7,594,422 | B2 | 9/2009 | Perry et al. | |
| 7,679,053 | B2 | 3/2010 | Schneider et al. | |
| 7,737,395 | B2 | 6/2010 | Goodley et al. | |
| 7,855,357 | B2 | 12/2010 | Truche et al. | |
| 8,525,111 | B1 | 9/2013 | Brown et al. | |
| 9,080,936 | B2 | 7/2015 | Brown et al. | |
| 9,177,765 | B2 | 11/2015 | Olney | |
| 9,842,727 | B2 * | 12/2017 | Gordon | H01J 49/0009 |
| 2004/0094706 | A1 | 5/2004 | Covey et al. | |
| 2005/0072915 | A1 | 4/2005 | Stults et al. | |
| 2007/0205361 | A1 | 9/2007 | Russ, IV et al. | |
| 2008/0245963 | A1 | 10/2008 | Land et al. | |
| 2013/0151190 | A1 | 6/2013 | Platt et al. | |
| 2013/0306856 | A1 | 11/2013 | Trimpin | |
| 2014/0239171 | A1 | 8/2014 | Platt et al. | |

* cited by examiner

AUTOMATED BEAM CHECK

CROSS-REFERENCE TO RELATED APPLICATIONS

This application is a continuation of U.S. patent application Ser. No. 15/022,444, filed 16 Mar. 2016, which will issue as U.S. Pat. No. 9,842,727 on 12 Dec. 2017, which is the National Stage Application of International Application No. PCT/GB2014/052811 filed 17 Sep. 2014, which claims priority from and the benefit of United Kingdom patent application No. 1316741.6 filed on 20 Sep. 2013 and European patent application No. 13185399.6 filed on 20 Sep. 2013. The entire contents of these applications are incorporated herein by reference.

BACKGROUND OF THE PRESENT INVENTION

The present invention relates to a method of automatically performing a routine on a mass spectrometer in order to check the operational state of the mass spectrometer. The method comprises a test routine which is automatically performed upon switching the mass spectrometer ON.

Miniature mass spectrometers are being developed which are intended to have a wide application and hence may be operated by users who have had no previous experience of operating a mass spectrometer. One of the problems associated with operating a mass spectrometer is that it can be difficult for an inexperienced user to determine whether or not the mass spectrometer is in a correct operational state.

WO 2013/081581 (Olney) discloses a method for automatically checking and adjusting the calibration of a mass spectrometer comprising a fragmentation cell. When a calibration check is performed the collision energy of ions entering the fragmentation cell is reduced to zero so that ions enter and are transmitted through the fragmentation cell without being fragmented.

U.S. Pat. No. 8,525,111 (Brown) discloses checking the operation condition of a Glow Discharge Ionisation ("GDI") source using an automated calibration process. A user can activate the calibration process whereupon one or more known reference samples are sequentially analysed. Detection of phantom peaks (i.e. peaks that should not exist in the measured spectra) can indicate that the GDI source is contaminated. Determination of whether the GDI source needs to be replaced can be based on the calibration results and in particular upon the number and size of phantom peaks detected.

U.S. Pat. No. 5,463,219 (Buckley) discloses a method of automatically performing a calibration procedure.

US 2013/0151190 (Waters) discloses software for automating the initial installation of a mass spectrometer.

WO 2013/039772 (Waters) discloses performing maintenance of a mass spectrometer wherein tests are performed before and after performing the maintenance and the results are compared.

US 2005/0072915 (Stults) discloses a method of self-optimising an Electrospray ionisation device.

US 2008/0098794 (Perry) discloses a method for automatically calibrating a trace detection portal.

U.S. Pat. No. 5,703,360 (Fischer) discloses a method of automatically calibrating a liquid chromatography device.

It is desired to provided an improved mass spectrometer and method of mass spectrometry.

SUMMARY OF THE PRESENT INVENTION

According to an aspect of the present invention there is provided a method of automatically performing a routine to check the operational state of a mass spectrometer, wherein the method is performed automatically as a start-up routine upon switching ON the mass spectrometer, the method comprising:

(i) automatically generating a vacuum within one or more vacuum chambers of a mass spectrometer;

(ii) automatically generating first ions using an internal ion source, wherein the internal ion source is located within a vacuum chamber of the mass spectrometer or is located within a chamber downstream from an atmospheric pressure interface, and detecting at least some of the first ions or second ions derived from the first ions; and then (iii) automatically determining whether or not the mass spectrometer is in a correct operational state.

The method disclosed in WO 2013/081581 (Olney) is not performed automatically as a start-up routine upon switching ON the mass spectrometer and does not comprise automatically generating a vacuum within one or more vacuum chambers of a mass spectrometer. Furthermore, the method disclosed in WO 2013/081581 (Olney) is not concerned with automatically generating first ions using an internal ion source, wherein the internal ion source is located within a vacuum chamber of the mass spectrometer or is located within a chamber downstream from an atmospheric pressure interface.

The method according to the present invention is particularly applicable in connection with a new generation of miniature mass spectrometers which are being developed and which are intended to have a wide application. Accordingly, the mass spectrometer may be operated by a user who has had no previous experience of operating a mass spectrometer. One of the problems associated with operating a mass spectrometer is that it can be difficult for an inexperienced user to determine whether or not the mass spectrometer is in a correct operational state.

The method according to the present invention advantageously enables an inexperienced user to determine whether or not the mass spectrometer is in a correct operational state. In particular, the routine according to the present invention is performed automatically upon start-up or switching ON the mass spectrometer and the checks are made using an internal ion source which is not accessible to the user.

In contrast, WO 2013/081581 (Olney) is not concerned with the problem of enabling an inexperienced user to determine whether or not a mass spectrometer is in a correct operational state.

The ion source preferably comprises an Electron Impact ("EI") ion source or a Glow Discharge ("GD") ion source.

The step of determining whether or not the mass spectrometer is in a correct operational state preferably comprises determining whether or not the first ions and/or the second ions are detected by an ion detector.

The step of determining whether or not the mass spectrometer is in a correct operational state preferably comprises determining whether or not first ions having mass to charge ratios within one or more defined ranges and/or second ions having mass to charge ratios within one or more defined ranges are detected by an ion detector.

The step of determining whether or not the mass spectrometer is in a correct operational state preferably comprises determining whether or not the mass resolution of the first ions and/or the mass resolution of the second ions is within a desired range.

The step of determining whether or not the mass spectrometer is in a correct operational state preferably comprises determining whether or not the determined mass, mass to charge ratio or mass position of the first ions and/or the second ions is within a desired range.

The method preferably further comprises entering an error state if it is determined that the mass spectrometer is not in a correct operational state.

The method preferably further comprises automatically retuning and/or automatically recalibrating the mass spectrometer if it is determined that the mass spectrometer is not in a correct operational state.

The method preferably further comprises automatically repeating one or more test or other procedures if it determined that the mass spectrometer is not in a correct operational state.

The method preferably further comprises automatically adjusting, resetting or resending one or more control parameters, voltages or signals if it determined that the mass spectrometer is not in a correct operational state.

According to an aspect of the present invention there is provided a mass spectrometer comprising:

an internal ion source located within a vacuum chamber of the mass spectrometer or located within a chamber downstream from an atmospheric pressure interface; and a control system which is arranged and adapted to perform a routine to check the operational state of the mass spectrometer automatically as a start-up routine upon switching ON the mass spectrometer, wherein the control system is arranged and adapted:

(i) automatically to generate a vacuum within one or more vacuum chambers of the mass spectrometer;

(ii) automatically to generate first ions using the internal ion source and to detect at least some of the first ions or second ions derived from the first ions; and then (iii) automatically to determine whether or not the mass spectrometer is in a correct operational state.

According to an aspect of the present invention there is provided a method of mass spectrometry wherein once the mass spectrometer or instrument is powered ON:

(i) the mass spectrometer or instrument preferably automatically pumps itself down;

(ii) once pumped the mass spectrometer or instrument preferably automatically enters an operational state;

(iii) a source of ions is preferably provided to the mass spectrometer or instrument;

(iv) a mass spectrum is preferably generated; and (v) if predetermined performance criteria are not met then the mass spectrometer or instrument preferably enters an error state.

According to a preferred embodiment an invisible or internal calibration source is provided and is used to provide a second or secondary source of ions. The secondary source of ions is preferably fed into the instrument or otherwise introduced into the mass spectrometer under the control of software/firmware. The internal calibration source is preferably operated automatically by the mass spectrometer without requiring input from the user.

Upon powering ON the mass spectrometer, the mass spectrometer according to the preferred embodiment pumps itself down and then preferably enters into an operational state once pumped. The control system of the preferred mass spectrometer is then preferably arranged to turn ON the second or secondary source of ions. The control system of the mass spectrometer switches ON an internal ion source to generate calibration or other ions and preferably does not require any involvement from the user.

According to an embodiment of the present invention an ion beam is preferably generated by the internal ion source and is preferably automatically analysed to determine: (i) that an ion beam exists and has been generated by the ion source; (ii) that ions are resolved correctly i.e. the ions have the expected mass or mass to charge and/or that ion peaks have an expected resolution; and (iii) that ions are mass measured correctly i.e. ion peaks have the correct resolution and/or known ions are determined to have the correct mass, mass to charge ratio or mass position.

If a determination is made that the ion beam is not correctly resolved or calibrated correctly then according to an embodiment the mass spectrometer will preferably attempt automatically to retune and/or recalibrate itself. Alternatively, the mass spectrometer may switch directly to a fail state and indicate to the user that the mass spectrometer is not in a correct operational state.

According to the preferred embodiment once automatic checks and/or start-up procedures have been completed, and the mass spectrometer is determined to be in a correct operational state then the mass spectrometer will then preferably report to the user or operator that the mass spectrometer is in a correct operational condition and is ready for use by the user.

According to an aspect of the present invention there is provided a method of automatically performing a routine to check the operational state of a mass spectrometer comprising:

(i) optionally automatically generating a vacuum within one or more vacuum chambers of a mass spectrometer;

(ii) automatically generating first ions and detecting at least some of the first ions or second ions derived from the first ions; and then (iii) automatically determining whether or not the mass spectrometer is in a correct operational state.

The method is preferably performed automatically as a start-up routine upon switching ON the mass spectrometer.

Alternatively, the method may be performed automatically following a user request.

The method preferably further comprises automatically generating the first ions using an internal ion source.

The internal ion source is preferably located within a vacuum chamber of a mass spectrometer or is located within a chamber downstream from an atmospheric pressure interface.

According to another aspect of the present invention there is provided a mass spectrometer comprising:

a control system which is arranged and adapted to perform a routine to check the operational state of the mass spectrometer, wherein the control system is arranged and adapted:

(i) optionally automatically to generate a vacuum within one or more vacuum chambers of the mass spectrometer;

(ii) automatically to generate first ions and to detect at least some of the first ions or second ions derived from the first ions; and then (iii) automatically to determine whether or not the mass spectrometer is in a correct operational state.

According to an aspect of the present invention there is provided a method of automatically performing a routine to check the operational state of a mass spectrometer, wherein the method is performed automatically at a predetermined service interval, the method comprising:

(i) automatically generating first ions using an internal ion source, wherein the internal ion source is located within a vacuum chamber of the mass spectrometer or is located within a chamber downstream from an atmospheric pressure interface, and detecting at least some of the first ions or second ions derived from the first ions; and then (ii) automatically determining whether or not the mass spectrometer is in a correct operational state.

According to an aspect of the present invention there is provided a mass spectrometer comprising:

an internal ion source located within a vacuum chamber of the mass spectrometer or located within a chamber downstream from an atmospheric pressure interface; and a control system which is arranged and adapted to perform a routine to check the operational state of the mass spectrometer automatically at a predetermined service interval, wherein the control system is arranged and adapted:

(i) to generate automatically first ions using the internal ion source and to detect at least some of the first ions or second ions derived from the first ions; and then (ii) to determine automatically whether or not the mass spectrometer is in a correct operational state.

According to an aspect of the present invention there is provided a method of remotely performing a routine to check the operational state of a mass spectrometer, wherein the method is initiated by a remote service engineer who is not physically present at the mass spectrometer, the method comprising:

(i) sending instructions via a telecommunications link to the control system of the mass spectrometer to generate first ions using an internal ion source, wherein the internal ion source is located within a vacuum chamber of the mass spectrometer or is located within a chamber downstream from an atmospheric pressure interface, and detecting at least some of the first ions or second ions derived from the first ions; and then (ii) determining whether or not the mass spectrometer is in a correct operational state and optionally communicating information concerning the operational state of the mass spectrometer to the remote service engineer via a or the telecommunications link.

According to an aspect of the present invention there is provided a mass spectrometer comprising:

an internal ion source located within a vacuum chamber of the mass spectrometer or located within a chamber downstream from an atmospheric pressure interface; and a control system which is arranged and adapted:

(i) to receive instructions sent via a telecommunications link by a remote service engineer who is not physically present at the mass spectrometer in order to remotely perform a routine to check the operational state of the mass spectrometer;

(ii) to generate first ions using the internal ion source in response to receiving the instructions and to detect at least some of the first ions or second ions derived from the first ions; and then (iii) to determine whether or not the mass spectrometer is in a correct operational state and optionally to communicate information concerning the operational state of the mass spectrometer to the remote service engineer via a or the telecommunications link.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wen filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The mass spectrometer may comprise a chromatography detector.

The chromatography detector may comprise a destructive chromatography detector preferably selected from the group consisting of: (i) a Flame Ionization Detector ("FID"); (ii) an aerosol-based detector or Nano Quantity Analyte Detector ("NQAD"); (iii) a Flame Photometric Detector ("FPD"); (iv) an Atomic-Emission Detector ("AED"); (v) a Nitrogen Phosphorus Detector ("NPD"); and (vi) an Evaporative Light Scattering Detector ("ELSD").

Alternatively, the chromatography detector may comprise a non-destructive chromatography detector preferably selected from the group consisting of: (i) a fixed or variable wavelength UV detector; (ii) a Thermal Conductivity Detector ("TCD"); (iii) a fluorescence detector; (iv) an Electron Capture Detector ("ECD"); (v) a conductivity monitor; (vi) a Photoionization Detector ("PID"); (vii) a Refractive Index Detector ("RID"); (viii) a radio flow detector; and (ix) a chiral detector.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions are preferably caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to a particularly preferred embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

The preferred embodiment relates to a mass spectrometer based chromatography detector for a High Pressure Liquid Chromatography ("H PLC") or similar system which utilises an automated method to measure directly the working state of the instrument or mass spectrometer.

The automated method preferably comprises an automated start-up routine which is preferably performed upon switching ON the mass spectrometer. The start-up routine is particularly useful for ensuring that a miniature mass spectrometer is in a correct operational state before being used by a user who may have no prior experience of operating a mass spectrometer.

A preferred miniature mass spectrometer will first be described with reference to FIGS. 1-2.

Figure 1:
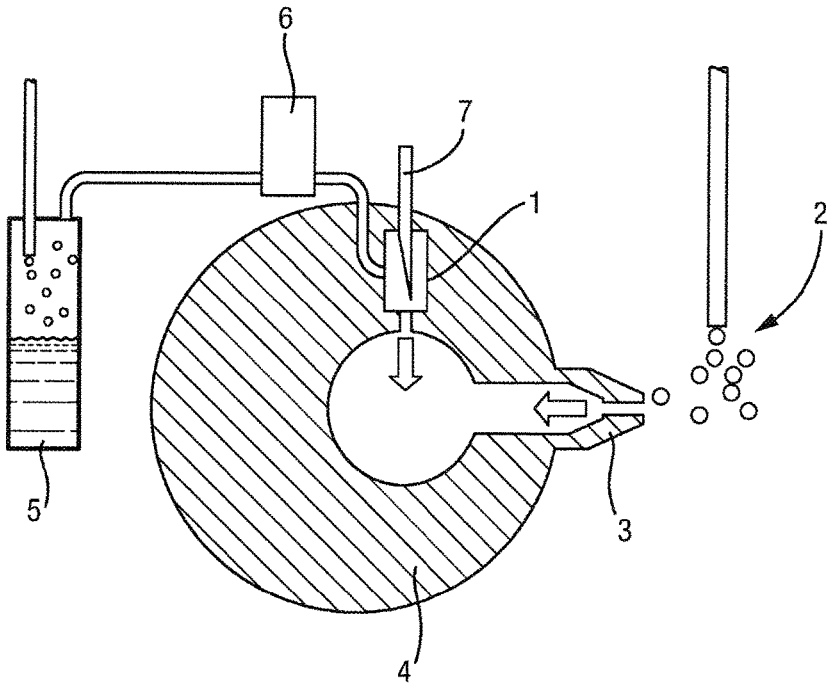
FIG. 1 shows an atmospheric pressure interface of a miniature mass spectrometer according to a preferred embodiment of the present invention wherein an internal ion source for automatically generating calibration ions is provided in addition to a conventional external ion source for generating analyte ions.

According to a particularly preferred embodiment the preferred automatic start-up routine is preferably implemented on a miniature mass spectrometer as shown in FIG. 1 which has an internal glow discharge ion source 1 as a secondary source of ions.

The preferred miniature mass spectrometer preferably comprises an Electrospray Ionisation ("ESI") ion source 2 which generates analyte ions which are preferably introduced into an ion block 4 of the mass spectrometer via a sample cone 3 which is attached to the ion block 4. The ion block 4 is preferably secured to the main housing of the mass spectrometer. The main housing of the mass spectrometer preferably incorporates multiple vacuum chambers (not shown).

Gas and/or a liquid may be held in a reservoir 5 and vapour is preferably passed via a solenoid valve 6 to a smaller chamber located within the body of the ion block 4. A sharp needle 7 is preferably provided within the chamber. A glow discharge is preferably formed within the chamber by applying a high voltage to the needle 7 with the result that vapour which is directed towards the needle 7 is preferably ionised to generate calibration or other ions. The calibration or other ions are then preferably emitted into the main internal passage within the ion block 4 such that the calibration or other ions are then preferably passed into the main housing of the mass spectrometer.

The sharp needle 7 is preferably placed in a small volume within the ion block 4 at a pressure of approximately 4 mbar. A small orifice preferably leads from the glow discharge region into the main ion block 4. A high voltage DC potential of approximately 800 V is preferably applied to the sharp needle 7 in order to initiate a glow discharge. Vaporized calibrant is preferably provided to the ion source by heating a small reservoir 5 which is partially filled with a liquid calibrant. A solenoid valve 6 is then preferably opened between the glow discharge source (at vacuum) and the reservoir 5. The reservoir 5 is preferably nominally at atmospheric pressure and a known length of capillary into the reservoir 5 from an ambient environment (atmosphere or a nitrogen gas line) preferably provides a fixed controlled leak which aids in the transport of vapour to the ion source.

A particularly preferred compound for calibration purposes is Fomblin Y which is a perfluoropolyether compound and which has been used as a vacuum pump oil due to its inertness, stability and low vapour pressure.

Figure 2:
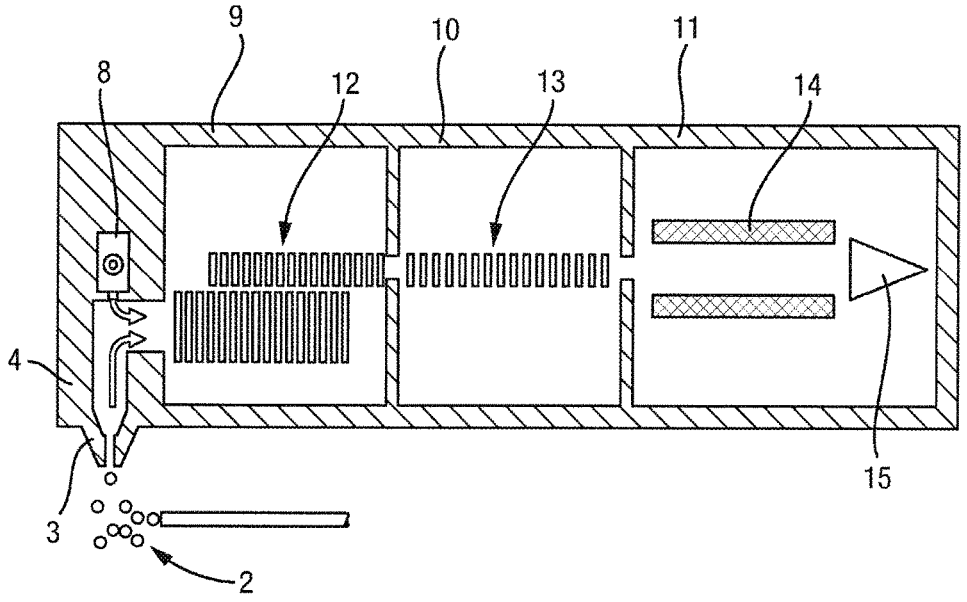
FIG. 2 shows a miniature mass spectrometer according to a preferred embodiment of the present invention.

FIG. 2 shows an overall representation of a miniature mass spectrometer according to a preferred embodiment of the present invention. An Electrospray ion source 2 preferably generates analyte ions which pass via a sample cone 3 into a main internal passage within the ion block 4. An internal glow discharge ion source 8 is located within the body of the ion block 4 and is preferably arranged to generate calibration or other ions. The resulting calibration or other ions are preferably emitted directly into the main internal passage within the ion block 4.

Analyte ions generated by the external ion source 2 and calibration or other ions generated by the internal ion source 8 are preferably directed into a first vacuum chamber 9 located within the main housing of the mass spectrometer. The first vacuum chamber 9 preferably houses a stepwave ion guide 12 i.e. a conjoined ion guide assembly wherein ions are preferably transferred in a generally radial direction from a first ion path formed within a first plurality of ring electrodes into a second ion path formed by a second plurality of ring electrodes. The first and second plurality of ring electrodes are preferably conjoined along at least a portion of their length. Ions are preferably radially confined within the first and second plurality of ring electrodes.

The second ion path is preferably aligned with a differential pumping aperture which preferably leads into a second vacuum chamber 10 housing a second ion guide 13. The second ion guide 13 preferably comprises an ion tunnel ion guide comprising a plurality of ring electrodes each having an aperture. Ions preferably pass through the apertures in each of the ring electrodes.

The ions are then preferably passed through a further differential pumping aperture into a third vacuum chamber 11 which preferably houses a quadrupole mass filter 14 and an ion detector 15. Other embodiments are contemplated wherein a different arrangement of ion guides may be provided and a mass analyser other than a quadrupole rod set mass analyser may be provided.

Automatic Routine

An automatic routine which is preferably performed by the mass spectrometer will now be described in more detail.

The determination of the working state (or otherwise) of the mass spectrometer is preferably automated such that once the mass spectrometer is powered ON by the user or operator, the mass spectrometer then preferably automatically pumps itself down. Once the mass spectrometer has automatically pumped itself down the control system then preferably automatically turns ON one or more high voltage ("HV") power supplies and/or may also turn ON one or more gas supplies when a sufficient vacuum level is reached.

The mass spectrometer then preferably acquires mass spectral data in order to determine that the mass spectrometer is working within predefined parameters and is preferably in a correct operational state.

According to a preferred embodiment an integrated or internal source of calibration or other ions is preferably utilised. The operation of the internal calibration source preferably does not require any input from a user. Calibration or other ions are preferably automatically generated and are preferably automatically directed into the mass analyser. The calibration or other ions are preferably subsequently detected and mass analysed as part of the automatic start-up routine according to a preferred embodiment of the present invention.

The source of calibration or other ions is preferably generated using an ion source of the mass spectrometer.

According to an embodiment an intrinsic source of ions may be used. For example, atmospheric gas molecules (e.g. oxygen, nitrogen) and/or water or solvent molecules which preferably continuously elute from a liquid chromatography ("LC") system even when a separation is not taking place may be used.

A secondary source of molecules may alternatively be provided and may either be directed into the liquid flow into the ion source or else may be introduced into one of the gas flows into the ion source.

According to an embodiment a secondary ion source may be provided in order to generate calibration or other ions. The secondary ion source may comprise an additional external ion source such as an (additional) Electrospray Ionisation ("ESI") ion source or an Atmospheric Pressure Chemical Ionisation ("APCI") ion source.

Accordingly to the preferred embodiment the secondary ion source is located internal to or within the vacuum system of the mass spectrometer. For example, according to the preferred embodiment the internal ion source may comprise an Electron Impact ("EI") ionisation or a Glow Discharge ("GD") ion source. The secondary ion source may be arranged to generate ions from intrinsic molecules such as atmospheric oxygen or nitrogen or alternatively and more preferably from an additional source such as a vial containing a calibration compound.

There are various methodologies and parameters that may be measured to determine whether or not the mass spectrometer is in a correct operational state. Some of the various determinations which may be made by the preferred control system are described in more detail below.

1. Determining Whether or not an Ion Beam is Present

According to an embodiment a simple determination may be made as to whether or not an ion beam is present. According to this embodiment a non-resolved ion beam (i.e. an ion beam which is not mass filtered) may be generated and the existence or otherwise of an ion current above a defined threshold may be used to determine that the mass spectrometer is working at least at a basic level.

2. Determining Whether or not a Resolved Ion Beam is Detected

According to an embodiment a determination may be made as to whether or not a mass or mass to charge ratio resolved ion beam is detected.

This determination may be made independently of whether or not a prior determination has been made that an ion beam is present as detailed above.

According to this embodiment a quadrupole mass filter is preferably set to resolve (i.e. mass filter or mass select) an ion beam so that an ion beam is onwardly transmitted which has a known or defined range of mass to charge ratios.

According to this embodiment the mass spectrometer preferably determines whether or not ions having mass to charge ratios within the mass to charge ratio transmission window transmitted by the mass filter are detected by an ion detector.

3. Determining Whether or not Multiple Resolved Ions are Detected

According to an embodiment a determination may be made as to whether or not multiple mass or mass to charge ratio resolved ions are detected.

This determination may be made independently of whether or not a prior determination has been made as detailed above.

According to this embodiment a quadrupole mass filter or other mass filtering device is preferably set or otherwise arranged to transmit ions having mass to charge ratios within certain mass windows and a resulting mass spectrum may be generated.

4. Determining Whether or not Ions have been Resolved Correctly

According to an embodiment a determination may be made as to whether or not ions have been mass or mass to charge ratio resolved correctly.

This determination may be made independently of whether or not a prior determination has been made as detailed above.

According to this embodiment the mass resolution of one or more ions may be measured in addition to intensity.

5. Determining Whether or not Mass has been Measured Correctly

According to an embodiment a determination may be made as to whether or not the mass of ions has been measured correctly.

This determination may be made independently of whether or not a prior determination has been made as detailed above.

According to this embodiment the mass position of one or more ions is preferably measured in addition to intensity and/or resolution.

6. Determining Whether or not to Auto-Retune

According to an embodiment a determination may be made as to whether or not to auto-retune.

This determination may be made independently of whether or not a prior determination has been made as detailed above.

According to this embodiment in the circumstance that one of the determinations as detailed above such as either the intensity, the resolution or the mass position not meeting a given requirement, then the mass spectrometer is preferably arranged to perform an automated procedure to re-set its resolution and/or to re-calibrate its mass position.

A determination to automatically retune the mass spectrometer may also be made upon criteria other than the criteria discussed above.

Further Details

Various automatic start-up procedures were performed using a miniature mass spectrometer substantially as shown in FIGS. 1 and 2.

Figure 3A:
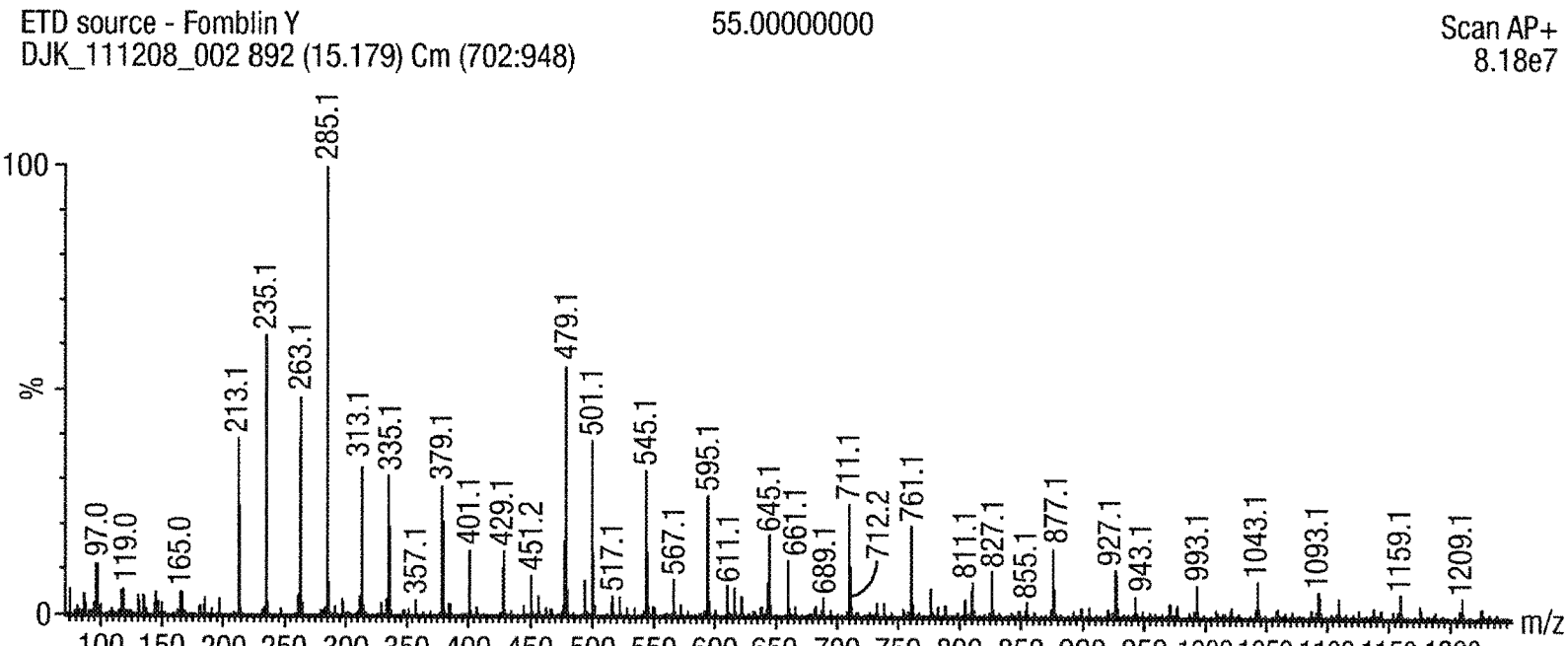
FIG. 3A shows a mass spectrum of a preferred calibration compound which was obtained in a positive ion mode indicating how a wide range of mass spectral peaks may be observed across a wide mass range and FIG. 3B shows a corresponding mass spectrum of the same calibration compound obtained in negative ion mode and which shows an improved and more consistent spread of mass spectral peaks.
Figure 3B:
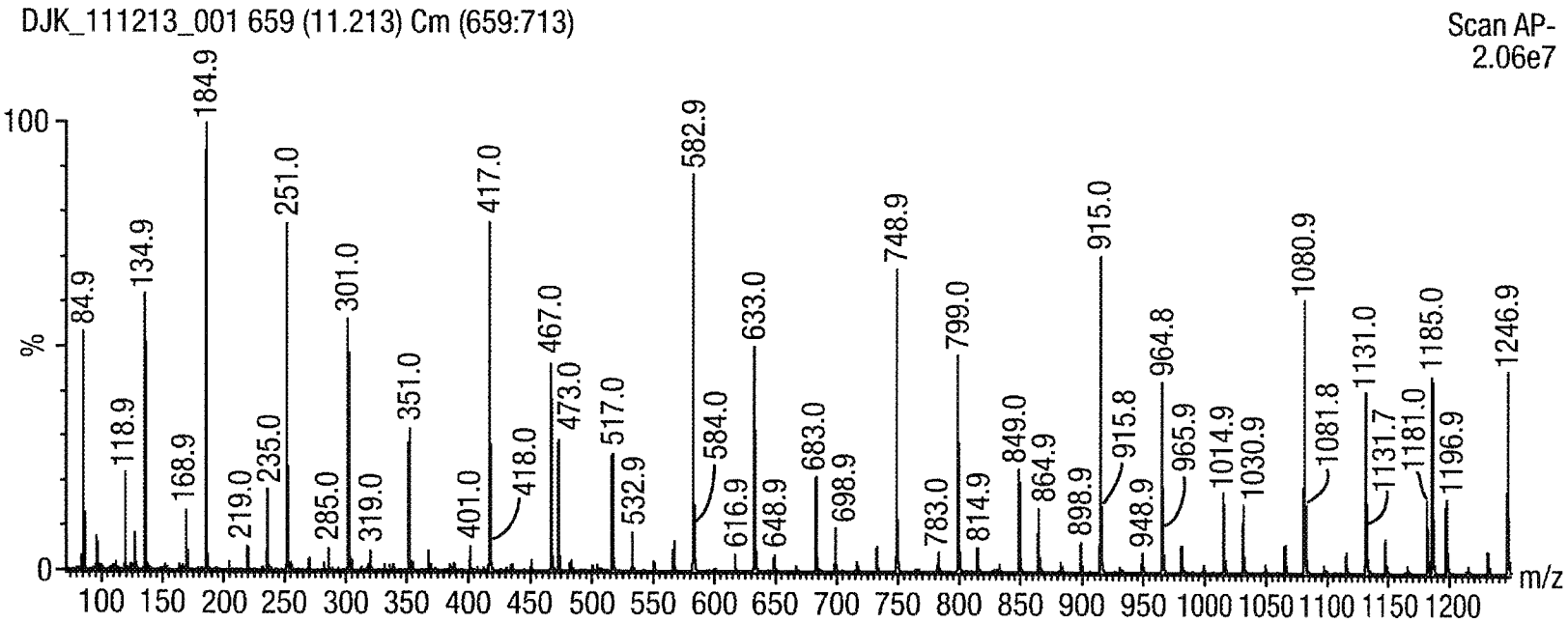

According to an embodiment a first mass spectrum of preferred calibration ions generated from Fomblin Y was obtained in positive ion mode and is shown in FIG. 3A and a second mass spectrum of preferred calibration ions generated from Fomblin Y was obtained in negative ion mode and is shown in FIG. 3B.

The mass spectra, particularly the mass spectrum shown in FIG. 3B which was obtained in negative ion mode, show an evenly spaced series of ions distributed across the mass range with a relatively low variation in intensity. Both these traits are highly desirable in a calibration compound.

Furthermore, since the preferred calibration compound (Fomblin Y) has a low vapour pressure and has widespread use as a vacuum oil, any inadvertent contamination of the mass spectrometer is preferably avoided.

Figure 4:
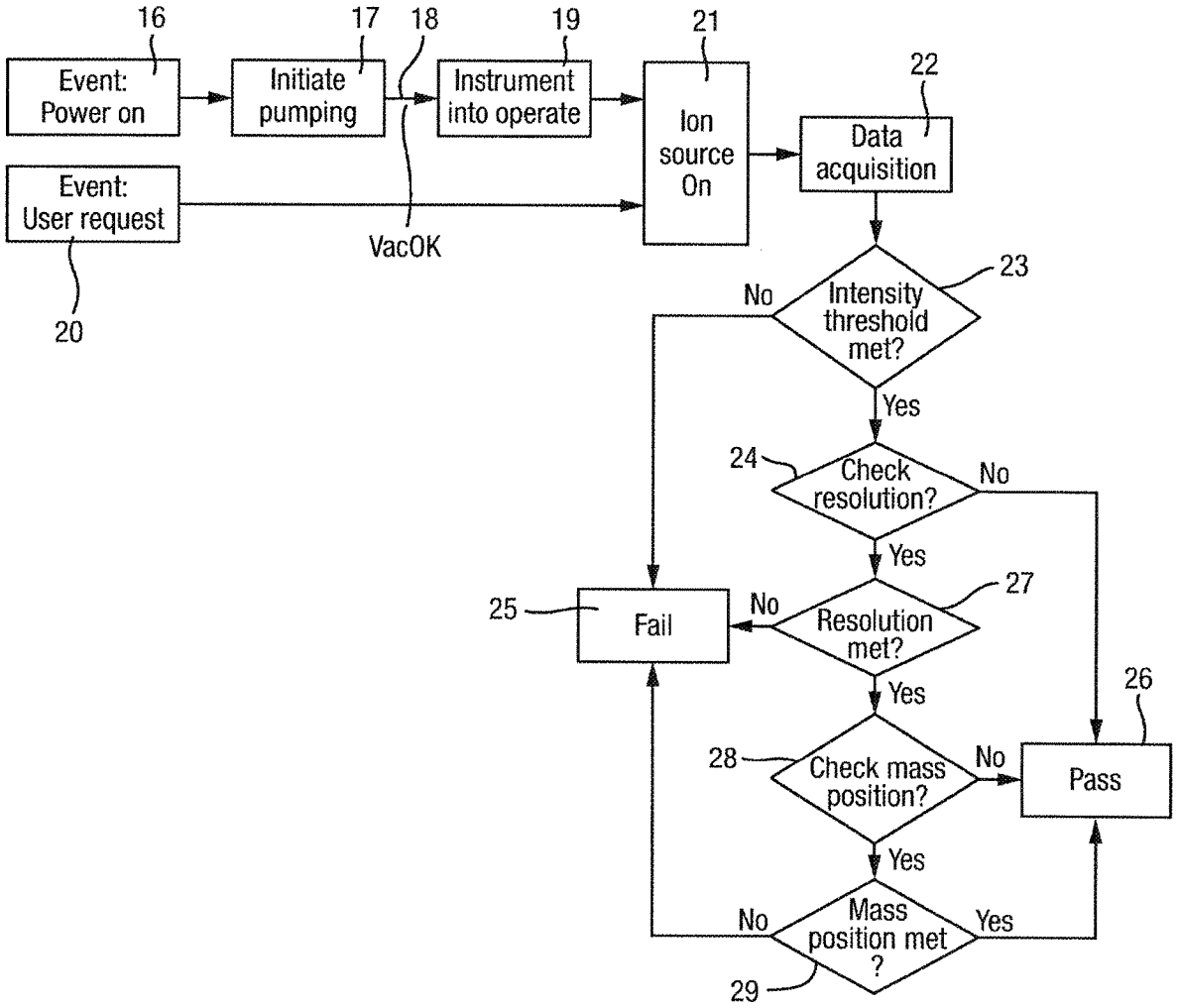
FIG. 4 shows a flow diagram of a preferred start-up routine according to an embodiment of the present invention and which indicates the automatic checks and test which are preferably made before the control system of the mass spectrometer places the mass spectrometer either in a pass or fail state.

An example of an automated start-up routine that may be pursued by a control system of a mass spectrometer according to an embodiment of the present invention is shown in FIG. 4 and will be described in more detail below.

According to a preferred embodiment upon switching the mass spectrometer ON as an initial step 16, the mass spectrometer is preferably arranged to automatically start pumping 17 the various vacuum chambers. A determination 18 is then preferably made that the vacuum pressures are within correct operational ranges. The mass spectrometer then preferably proceeds to switching into an operational mode 19 and subsequent determinations are preferably automatically made that the mass spectrometer is in a correct operational state.

According to a less preferred embodiment of the present invention a user may initiate 20 the mass spectrometer to perform a routine to check the operational state of the mass spectrometer. The user may initiate the routine after it has been established that the vacuum pressures are in a correct operational range. It is not essential, therefore, that the routine is performed upon start-up, although performing the routine automatically upon start-up is particularly preferred. Other embodiments are also contemplated wherein a check may be made as to the operational state of the mass spectrometer at a predetermined service interval (e.g. after a predetermined number of operational hours, after a predetermined period of time or after a predetermined number of experimental acquisitions have been performed etc.)

The routine to check the operational state of the mass spectrometer preferably comprises switching an ion source ON 21. The ion source preferably comprises an internal ion source such as a glow discharge ion source as shown and described above with reference to FIGS. 1 and 2. Data is preferably acquired 22 and a determination is then preferably made at a subsequent step 23 as to whether or not an intensity threshold has been met. If the intensity threshold is met then the routine preferably proceeds to a step 24 wherein it is determined whether or not to check the resolution of the ion beam. If the intensity threshold is not met then the routine preferably proceeds to a fail step 25 wherein the mass spectrometer is considered not to be in a correct operational state.

If it is not desired to check the resolution of the ion beam then the routine may then proceed directly to a pass step 26 wherein the mass spectrometer is considered to be in a correct operational step.

If it is desired to check the resolution then the routine then preferably proceeds to a step 27 wherein a determination is made as to whether or not the resolution is met. If the resolution is not met then the routine preferably proceeds to a fail step 25 as detailed above. If the resolution is met then the routine preferably proceeds to a further step 28 wherein a check is preferably made as to whether or not it is desired to check the mass position. If it is not desired to check the mass position then the routine then preferably proceeds to the pass step 26 as detailed above. If it is desired to check the mass position then the routine preferably proceeds to a step 29 wherein a determination is made as to whether or not the mass position requirement(s) are met.

If the mass position requirement(s) are met then the routine preferably passes to the pass stage 26 as detailed above. If the mass position requirement(s) are not met then the routine preferably passes to the fail stage 25 as detailed above.

Various alternative embodiments are contemplated. In particular, determinations as to whether or not an intensity threshold is met 23, as to whether or not a resolution is met 27 and as to whether or not mass position requirement(s) are met 29 may be performed in a different order to the order illustrated by the flow diagram shown in FIG. 4.

Although the present invention has been described with reference to preferred embodiments, it will be understood by those skilled in the art that various changes in form and detail may be made without departing from the scope of the invention as set forth in the accompanying claims.

The invention claimed is:

1. A method of automatically performing a routine to check the operational state of a mass spectrometer, said method comprising:

(i) automatically generating a vacuum within one or more vacuum chambers of a mass spectrometer;

(ii) automatically generating first ions using an ion source, and detecting at least some of said first ions or second ions derived from said first ions; and then (iii) automatically determining whether or not said mass spectrometer is in a correct operational state;

wherein said method is performed automatically as a start-up routine upon switching ON said mass spectrometer.

2. A method as claimed in claim 1, wherein the step of determining whether or not said mass spectrometer is in a correct operational state comprises determining whether or not said first ions and/or said second ions are detected by an ion detector.

3. A method as claimed in any of claim 1, wherein the step of determining whether or not said mass spectrometer is in a correct operational state comprises determining whether or not first ions having mass to charge ratios within one or more defined ranges and/or second ions having mass to charge ratios within one or more defined ranges are detected by an ion detector.

4. A method as claimed in claim 1, wherein the step of determining whether or not said mass spectrometer is in a correct operational state comprises determining whether or not the mass resolution of said first ions and/or the mass resolution of said second ions is within a desired range.

5. A method as claimed in claim 1, wherein the step of determining whether or not said mass spectrometer is in a correct operational state comprises determining whether or not the determined mass, mass to charge ratio or mass position of said first ions and/or said second ions is within a desired range.

6. A method as claimed in claim 1, further comprising entering an error state if it is determined that said mass spectrometer is not in a correct operational state.

7. A method as claimed in claim 1, further comprising automatically retuning and/or automatically recalibrating said mass spectrometer if it is determined that said mass spectrometer is not in a correct operational state.

8. A method as claimed in claim 1, further comprising automatically repeating one or more test or other procedures if it determined that said mass spectrometer is not in a correct operational state.

9. A method as claimed in claim 1, further comprising automatically adjusting, resetting or resending one or more control parameters, voltages or signals if it determined that said mass spectrometer is not in a correct operational state.

10. A mass spectrometer comprising:

an ion source; and a control system which is arranged and adapted to perform a routine to check the operational state of the mass spectrometer automatically as a start-up routine upon switching ON said mass spectrometer, wherein said control system is arranged and adapted:

(i) automatically to generate a vacuum within one or more vacuum chambers of the mass spectrometer;

(ii) automatically to generate first ions using said ion source and to detect at least some of said first ions or second ions derived from said first ions; and then (iii) automatically to determine whether or not said mass spectrometer is in a correct operational state.

11. A method of automatically performing a routine to check the operational state of a mass spectrometer, the method comprising:

(i) automatically generating first ions using an ion source, and detecting at least some of the first ions or second ions derived from the first ions; and then (ii) automatically determining whether or not the mass spectrometer is in a correct operational state;

wherein the method is performed automatically as a start-up routine upon switching ON the mass spectrometer or wherein the method is performed automatically at a predetermined service interval.

* * * * *